US007412800B2

(12) United States Patent
Maier

(10) Patent No.: US 7,412,800 B2
(45) Date of Patent: Aug. 19, 2008

(54) LATCHING AND ANTI-BOW MECHANISM FOR A WINDOW

(76) Inventor: Robert G. Maier, 40 Prescott, Hudson, OH (US) 44236

( * ) Notice: Subject to any disclaimer, the term of this patent is extended or adjusted under 35 U.S.C. 154(b) by 670 days.

(21) Appl. No.: 10/678,904

(22) Filed: Oct. 3, 2003

(65) Prior Publication Data

US 2005/0072075 A1 Apr. 7, 2005

(51) Int. Cl.
*E05D 15/22* (2006.01)

(52) U.S. Cl. ..... 49/185; 49/183; 49/176; 292/DIG. 47

(58) Field of Classification Search ..... 49/176, 49/181, 183, 184, 185, 187, 449; 292/3, 292/32, 33, DIG. 20, 156, 35, 36, 38, DIG. 47
See application file for complete search history.

(56) References Cited

U.S. PATENT DOCUMENTS

| | | | | | |
|---|---|---|---|---|---|
| 655,382 | A | | 8/1900 | Talbot | |
| 660,438 | A | * | 10/1900 | Holly | 49/185 |
| 928,005 | A | * | 7/1909 | Roberts | 49/201 |
| 2,500,849 | A | * | 3/1950 | Menns | 49/181 |
| 3,529,381 | A | | 9/1970 | Grossman | |
| 4,095,892 | A | | 6/1978 | Thornton | |
| 4,226,050 | A | | 10/1980 | Kessler | |
| 4,253,688 | A | | 3/1981 | Hosooka | |
| 4,525,952 | A | * | 7/1985 | Cunningham et al. | 49/449 |
| 4,553,353 | A | | 11/1985 | Simpson | |
| 4,624,073 | A | * | 11/1986 | Randall | 49/161 |
| 4,961,286 | A | | 10/1990 | Bezubic | |
| 4,991,886 | A | | 2/1991 | Nolte et al. | |
| 5,083,398 | A | | 1/1992 | Kolbeck et al. | |
| 5,087,087 | A | | 2/1992 | Vetter et al. | |
| 5,090,750 | A | | 2/1992 | Lindqvist | |
| 5,118,145 | A | | 6/1992 | Tucker | |
| 5,127,685 | A | | 7/1992 | Dallaire et al. | |
| 5,152,103 | A | | 10/1992 | Tucker et al. | |
| 5,244,238 | A | | 9/1993 | Lindqvist | |
| 5,301,989 | A | | 4/1994 | Dallmann et al. | |
| 5,398,447 | A | * | 3/1995 | Morse | 49/185 |
| 5,414,962 | A | | 5/1995 | Forbis et al. | |
| 5,448,857 | A | | 9/1995 | Stormo | |
| D371,502 | S | | 7/1996 | Morris | |
| 5,531,045 | A | | 7/1996 | Piltingsrud | |
| 5,560,149 | A | | 10/1996 | Lafevre | |
| RE35,463 | E | | 2/1997 | Vetter et al. | |
| 5,620,213 | A | | 4/1997 | Ellis | |
| 5,715,631 | A | | 2/1998 | Kailian et al. | |
| 5,741,031 | A | | 4/1998 | Bauman et al. | |
| 5,791,700 | A | | 8/1998 | Biro | |
| 5,813,710 | A | | 9/1998 | Anderson | |
| 5,832,666 | A | | 11/1998 | Flack, II et al. | |
| 5,901,499 | A | | 5/1999 | Delaske et al. | |
| 5,927,767 | A | | 7/1999 | Smith et al. | |
| 5,934,031 | A | | 8/1999 | deNormand | |
| 5,970,656 | A | | 10/1999 | Maier | |
| 5,992,907 | A | | 11/1999 | Sheldon et al. | |

(Continued)

*Primary Examiner*—Gregory J. Strimbu
(74) *Attorney, Agent, or Firm*—Pearne & Gordon LLP

(57) ABSTRACT

A latching system for a double-hung window including upper latches and anti-bow latches where the upper latches and the anti-bow latches are operated by a common activating mechanism for ease of use of the window. A single activating mechanism may be utilized for latches on both sides of a window, or separate activating mechanisms may be used for each side of the window.

16 Claims, 4 Drawing Sheets

U.S. PATENT DOCUMENTS

| | | | | |
|---|---|---|---|---|
| 5,996,283 | A | 12/1999 | Maier | |
| 6,109,668 | A | 8/2000 | Demarco | |
| 6,135,511 | A | 10/2000 | Smith et al. | |
| 6,230,457 | B1 | 5/2001 | Brautigam | |
| 6,279,266 | B1 * | 8/2001 | Searcy | 49/183 |
| 6,305,126 | B1 | 10/2001 | Hendrickson et al. | |
| 6,363,659 | B1 | 4/2002 | Wang | |
| 6,679,001 | B1 * | 1/2004 | Guelck | 49/183 |
| 6,817,142 | B2 | 11/2004 | Marshik | |
| 6,877,784 | B2 * | 4/2005 | Kelley et al. | 292/241 |
| 2002/0092241 | A1 | 7/2002 | Uken et al. | |
| 2002/0116874 | A1 | 8/2002 | Marshik | |

* cited by examiner

FIG. 4
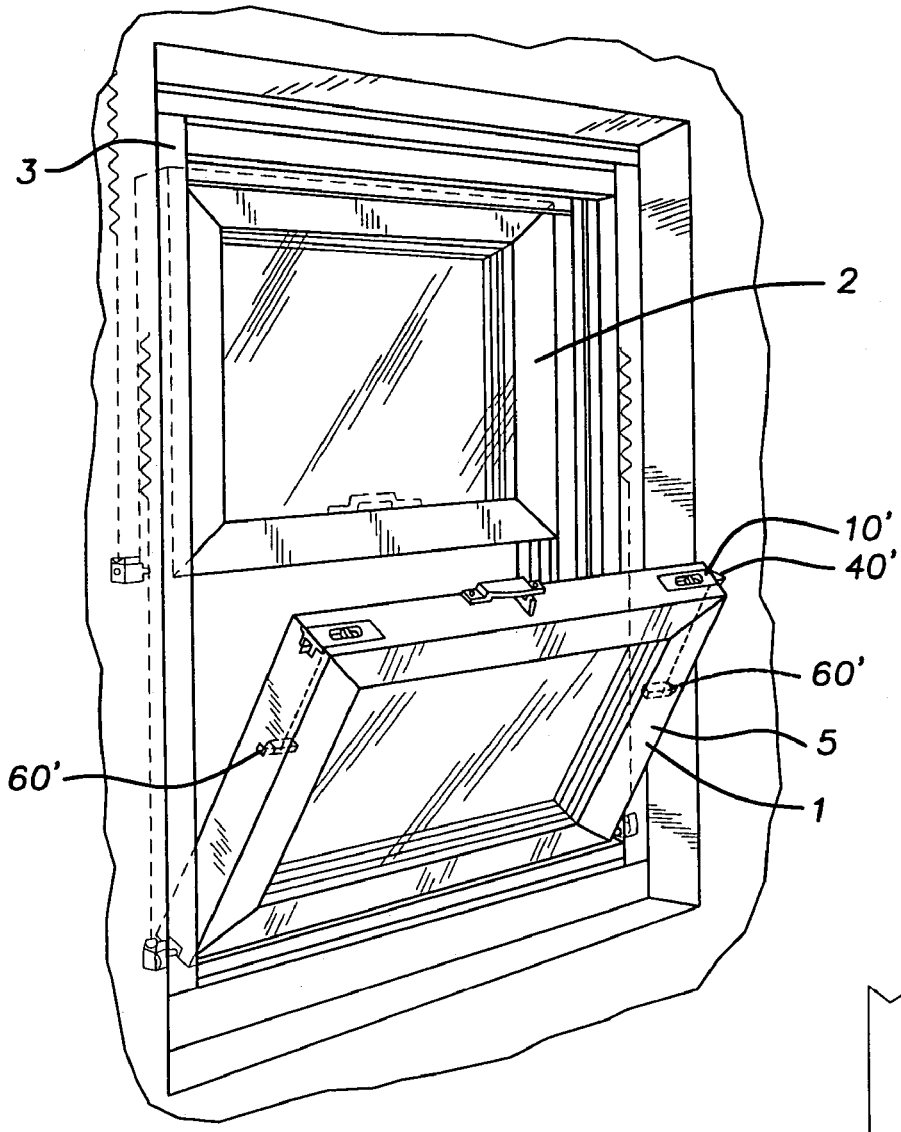
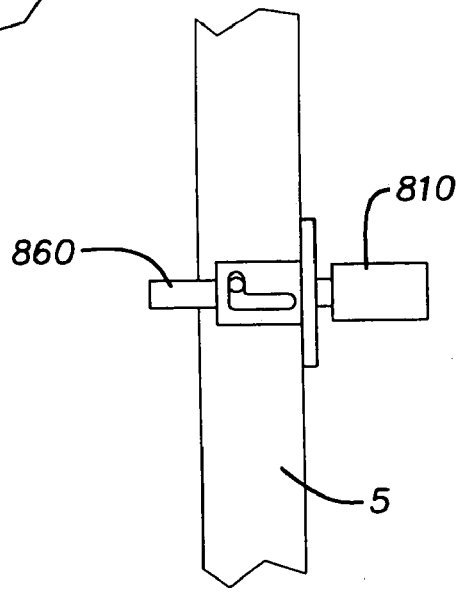
FIG. 6

LATCHING AND ANTI-BOW MECHANISM FOR A WINDOW

This invention relates generally to the field of window hardware and specifically to a system for operating the latching mechanisms including an anti-bow latch for a tilt-in double hung window assembly.

BACKGROUND OF THE INVENTION

Typical double hung windows have at least one vertically sliding window sash with pivots at the bottom corners of the window sash and releasable latches near the top corners of the sash that disengage from tracks in the window frame to allow the window to tilt in for ease of cleaning. These releasable latches are most commonly actuated by means of rotating or sliding levers (commonly known as tilt latches) positioned on the top surface of the sash, which operate to retract the locking points from tracks in the window jamb. The most typical embodiment of this latching arrangement involves a separate lever or similar operator designed to engage and disengage each latch, resulting in multiple operating mechanisms protruding from the window sash and the need to actuate multiple operators in order to tilt in the window.

An established shortcoming of the typical tilt-in style double hung window is that sometimes there is a lack of an adequate seal between the window sash and the jamb of the window frame. In order for the double hung window to tilt in freely upon disengagement of the releasable latches, the portion of the window sash between the pivot points at its base and the releasable latches at the upper end cannot be permanently fastened within the window frame. As a result, high perpendicular forces against the window, resulting from strong winds, for example, can result in inward bowing of the window sash and distortion of the sash and frame sealing edges. This problem is even more pronounced with larger windows having larger gaps between pivot and upper latch points, or windows in multi-story office or apartment buildings, which are routinely exposed to high velocity winds at the upper floors.

To overcome this problem, additional locking mechanisms can be added to the sides of the window sash at an intermediate point between the pivot points and the releasable latches. U.S. Pat. No. 4,525,952 to Cunningham et al. discloses a tilt-in window with two levers at the top of the window sash designed to retract two upper latches, and two levers on the sides of the window sash that retract two additional latches, intended to provide additional stability for the window and an improved seal. While this addresses some aspects of the inward bowing concerns, the multiple levers result in a cumbersome process for locking and unlocking the window sash, as well as an aesthetically cluttered window design.

The inconvenience of operating two release levers to retract upper latches to tilt in the window sash has prompted the development of window designs employing a single, centrally located handle or lever designed to retract both tilt latches, through use of such mechanisms as a linked cam or retracting cables. See, for example, U.S. Pat. No. 5,992,907 to Sheldon et al., U.S. Pat. No. 5,090,750 to Lindqvist, and U.S. patent application Ser. No. 10/041,784 to Marshik. However, the problem of effectively and conveniently retracting both traditional upper latches and intermediate (anti-bow) locking mechanisms has not been addressed. Further, by themselves, the simple mechanical means of retracting these locking latches, as disclosed in the prior art, are not capable of retracting additional locking points that are not horizontally in-line with the lever and upper locking points.

SUMMARY OF THE INVENTION

Provided is a latching system for a tilt-in double hung window, having an upper latch member, an anti-bow latch member, and an activating member, which is connected to the upper latch member and the anti-bow latch member for operating both the upper latch member and the anti-bow latch member.

Also provided is a latching system as described above, wherein the upper latch member is disposed in an upper rail of the window sash, and the anti-bow latch is disposed in a side stile of the window sash. Both the upper latch member and anti-bow latch member engage with a slide channel within the window frame. An operating mechanism is provided to connect the activating member with the upper latch member and the anti-bow latch member, so that actuation of the activating member disengages or engages both the upper latch member and the anti-bow latch member from the slide channel.

Further provided is a latching system as described above, wherein the operating mechanism comprises an upper latch operating mechanism for connecting the activating member with the upper latch member, and an anti-bow latch operating mechanism for connecting the activating member with the anti-bow latch member.

Further provided is a latching system as described above, wherein the operating mechanism comprises an upper latch operating mechanism for connecting the activating member with the upper latch member, and an anti-bow latch operating mechanism for connecting the activating member with the anti-bow latch member.

Still further provided is a latching system as described above, wherein a central activating member activates all latches.

BRIEF DESCRIPTION OF THE DRAWINGS

FIG. 4 shows a perspective view of an unlatched and tilted open window sash in accordance with an alternative embodiment of the present invention having two side activating members;

FIG. 6 shows an anti-bow latch member and corresponding activating member disposed on a window sash stile.

DETAILED DESCRIPTION OF THE PREFERRED EMBODIMENTS

The present invention contemplates a mechanism for installation in a double hung window sash having, for example, a single or pair of actuators designed to retract one or both of the upper latches common to a tilting window, and also for retracting one or more additional bow preventing (anti-bow) side latches on the sides of the window sash. Actuation of the actuator simultaneously or sequentially retracts a multiplicity of latches (such as an upper latch and an anti bow latch, for example, or two pairs of the latches simultaneously—thus four latches—as another example), providing easier tilting when opening, and prevention of bowing in the window's closed and locked position.

More specifically, one embodiment of the invention includes an activating member located on the upper rail of the window sash connected to two upper latches to retract the latches when the activating member is operated, disengaging the latches from the slide channel within the window frame. These connections may comprise one of several designs—some disclosed herein—constructed to retract two latches using one operator, such as a linked cam assembly, a cam and a spring loaded piston-rod assembly, or a retracting cable configuration, as examples. Alternatively, another embodiment of the invention includes the use of a pair of activating members each of which actuate only one upper latch member a side of the window and also actuate any anti-bow latch members on that same side. The side activating members could be designed to be consistent with the more traditional tilt latches known in the field, such as the sliding tilt latch described, for example, in U.S. Pat. No. 4,553,353 to Simpson and U.S. Pat. No. 5,970,656 to Meier, or a pivoting lever-type tilt latch described, for example, in U.S. Pat. No. 4,961,286 to Bezubic and U.S. Pat. No. 5,301,989 to Dallmann et al., all incorporated herein by reference.

In either above approach, the activating member is connected to one or more side anti-bow latches, located vertically between the window's pivot points and the upper latches within the window sash stile, in order to engage or disengage the anti-bow latches from the window frame slide channels when the activating member is operated. These connections may be designed and arranged so as to be connected with the upper latch connection mechanisms, or they may be independent of the upper latch operation. These connections may comprise one of several designs that will translate a movement of the activating member or the upper latch connection mechanisms to a vertically displaced movement, a lateral movement, a rotational movement, or some other movement sufficient to retract the anti-bow latches. Examples of such an operating connection include a cable and pulley system, a vertically extended gear linkage, a flexible retractable tape-like member in an L-shaped slot, or a vertical linkage with retracting roller assembly.

Figure 1A:
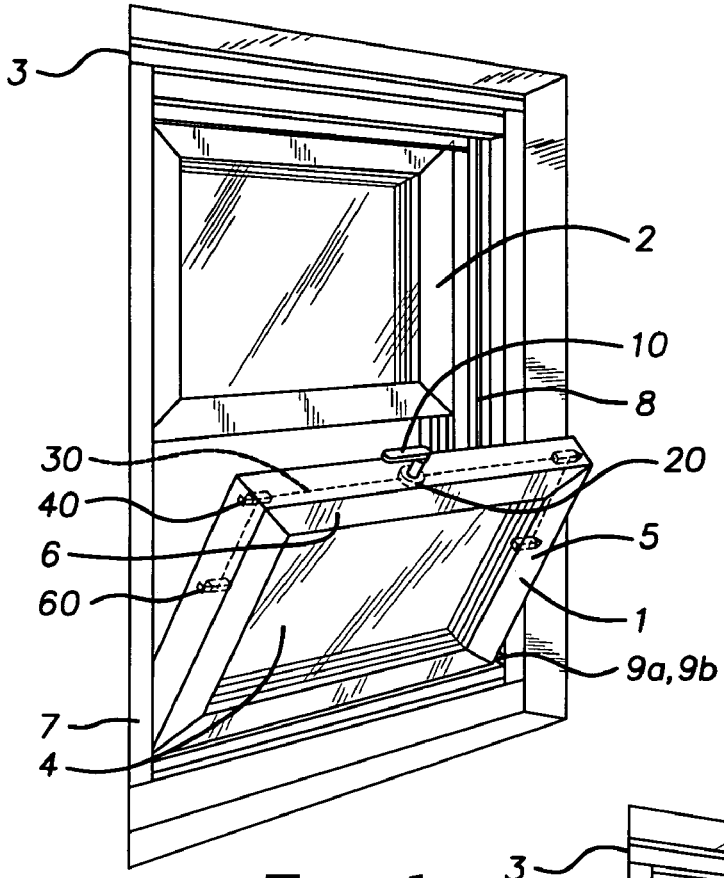
FIG. 1A shows a perspective view of an unlatched and tilted open window sash in accordance with an embodiment of the present invention having one centrally located activating member.

Referring to FIG. 1A, a double hung window assembly 1 includes an upper sash 2 and a lower sash 4 that are slidable in a window frame 3. The lower sash 4, for example, includes vertically disposed stiles 5 and horizontally disposed rails 6, including an upper sash rail and a lower sash rail, where the sash rails and stiles meet to form the corners of the window sash.

The window frame includes vertical jambs 7 defining opposed vertical slide channels 8. Brake assemblies 9*a* are slidable in respective slide channels 8. Lower corners of the lower sash 4 are provided with pivot assemblies 9*b* that are associated with respective brake assemblies 9*a* to define pivot and brake assemblies. The brake assemblies 9*a* can be supported by respective counterbalances, such as balance springs disposed in the slide channels 8, for example. Upper latch members 40 are disposed in the upper corners of the sash, and anti-bow latch members 60 are disposed in the vertical stiles 5 of the sash 4, positioned between the pivot assemblies 9*b* and the upper latch members 40. The upper latch members 40 and anti-bow latch members 60 engage within the slide channels 8 in the window's locked position, as shown in FIG. 1B, and provide for releasable engagement of the sash 4 in the slide channels 8 by operation of a single activating member (10, 20).

Figure 1B:
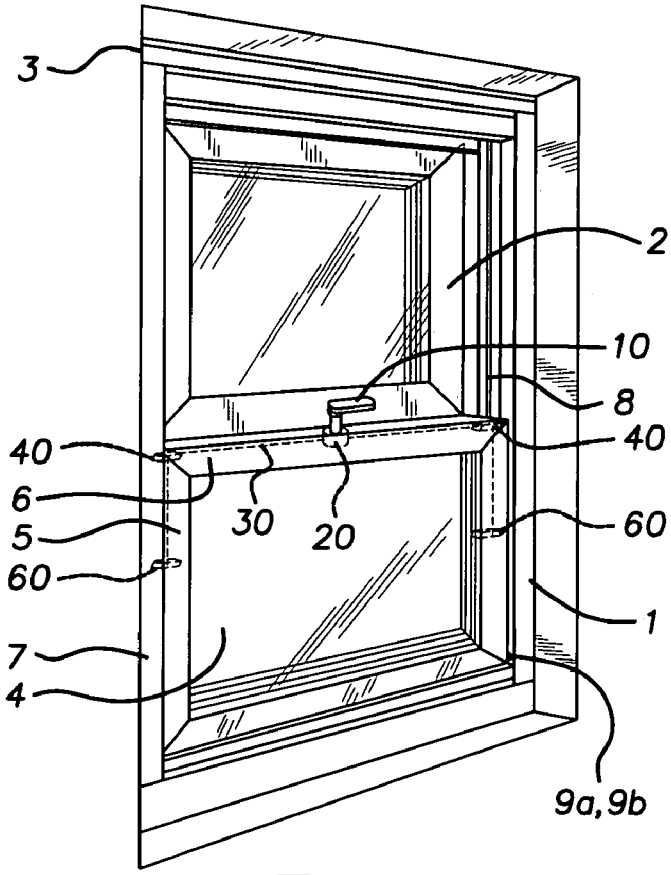
FIG. 1B shows a perspective view of a latched and closed window sash in accordance with the present invention.
Figure 2:
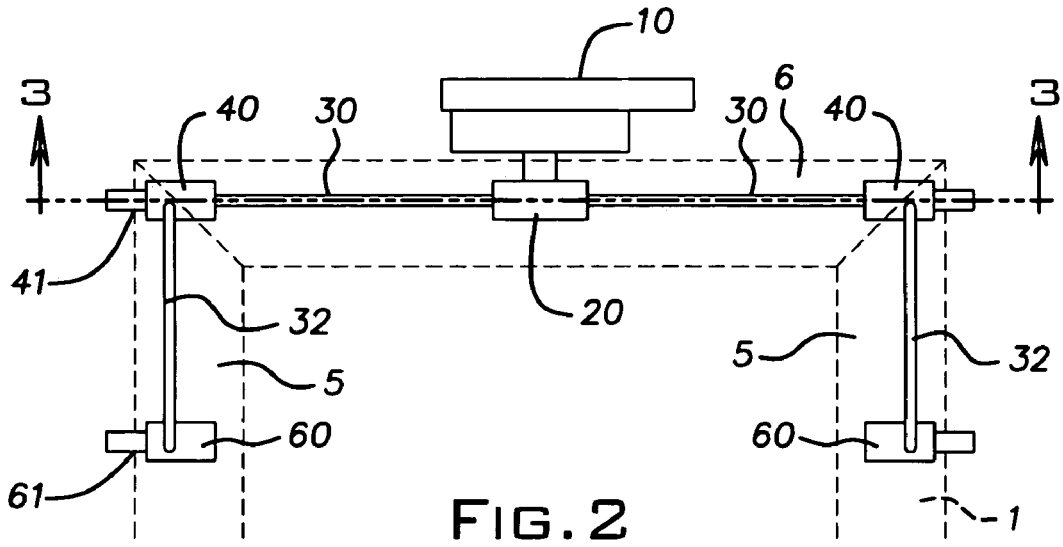
FIG. 2 shows a front sectional view of the single activating member locking system according to the invention.

Referring to FIG. 2, an opening 41 is provided in the upper portions of the sash stiles 5 to allow protrusion of the upper latch members 40 into the slide channels 8 (shown in FIGS. 1A and 1B). Likewise, an opening 61 is provided in the middle portion of the sash stiles 5 to allow protrusion of the anti-bow latch members 60 into the slide channels. In the pictured configuration, the upper sash rail 6 encloses one or more operating mechanisms (30, 32) for retracting one or both of the upper latch members 40 and/or one or both of the anti-bow latch members 60.

A central activating member including, for example, an actuator 10 and a pivoting component 20, is also shown in FIG. 2, to which the operating mechanism is attached for activating the latches. The operating mechanism can include a horizontal linking member 30 and a vertical linking member 32, for example, which can be implemented in a number of different ways.

Centrally positioned on the upper surface of the sash rail 6 is the actuator 10, such as a handle, switch, or lever, for example, which is connected to the pivoting component 20 through an opening in the upper sash rail 6, thus making up the activating member. The upper linkage assembly shown in the figure is constructed such that operation of the actuator 10 rotates the pivoting component 20, causing the horizontal linking members 30 to retract the upper latches 40 into the upper sash rail 6, thereby disengaging the upper latches 40 from the slide channels, although other implementations of the activating member are contemplated (some of which are discussed hereinbelow).

The vertical linking members 32 are for connecting the horizontal linking members 30 and/or the upper latch 40 to one or more corresponding anti-bow latching members 60, for activating the anti-bow latching members. Thus, a single operation of the activating member via the actuator 10 will activate both the upper latches and the anti-bow latches, preferably simultaneously.

Figure 3A:
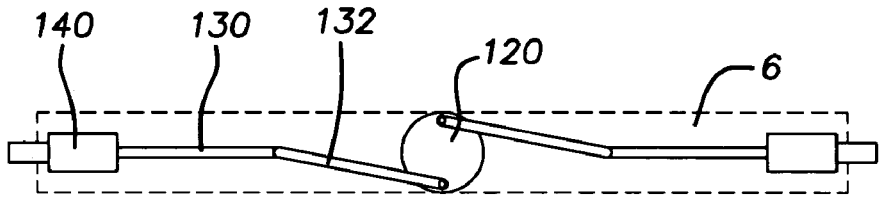
FIG. 3A shows a top sectional view taken through section 3-3 of FIG. 2 of the locking system in accordance with an embodiment of the invention utilizing a rotating cam and pivoting linkage arrangement.

Referring to FIG. 3A, one embodiment of the invention would employ retracting links 130 connected to rotating links 132 for form the horizontal linking member. The retracting link 130 is connected to a rotating cam 120 included in the activating member. The retracting links 130 would attach to the upper latch members 140 at the end opposite to the end connected to the rotating link 132. Operation of the actuator 10 would turn the rotating cam 120, angling the rotating links 132 inward, thereby retracting the retracting links 130 and retracting the upper latch members into the sash rail 6.

Figure 3B:
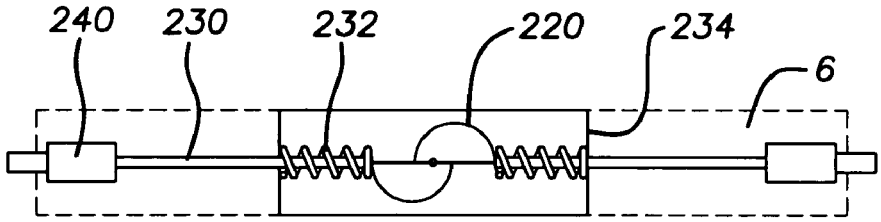
FIG. 3B shows a top sectional view taken through section 3-3 of FIG. 2 of the locking system in accordance with an embodiment of the invention utilizing a rotating cam and spring-loaded piston rod.

Referring to FIG. 3B, another embodiment of the invention would utilize a rotating cam 220 having a varying radius as part of the activating member. The rotating cam, when rotated via the actuator 10, displaces two elastically-loaded piston rods 230, which extend to engage the upper latch members 240 with the slide channels 8 (shown in FIGS. 1A and 1B). Elastic members 232 (which might be springs, for example), can be connected to a side of support walls 234 in the window sash rail 6 on one end, and connected to the ends of the piston rods 230 on the opposite end, such that the elastic forces will cause the piston rods and latch members 240 to retract when the smaller diameter portion of the S-shaped cam 220 is exposed to the piston rods 230, disengaging the latch members 240 from the slide channels.

Figure 3C:
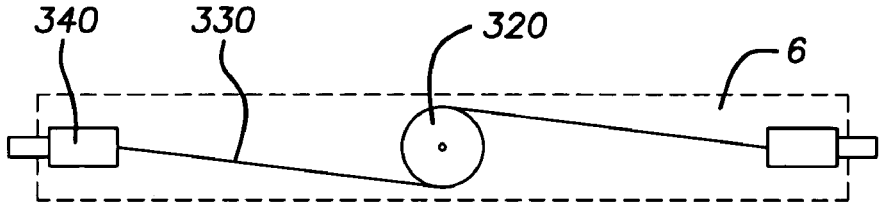
FIG. 3C shows a top sectional view taken through section 3-3 of FIG. 2 of the locking system in accordance with an embodiment of the invention utilizing a rotating cam and retracting cable.

Referring to FIG. 3C, yet another possible embodiment of the invention would include a rotating cam 320 as part of the activating member to which a retractable cable 330 is attached as the horizontal linking member. When actuating the activating member, the cable 330 would wind around the rotating cam 320, retracting the upper latch 340 into the sash stile 5.

Additional solutions for retracting the upper latches may include a rack and gear assembly in which latches are extended or retracted by horizontal rack components that are laterally adjusted by a central rotating gear attached to the lever. Other known means of retracting the upper latches can also be utilized. The possible embodiments of this upper linkage assembly, used to retract and extend the upper latches, are not limited to those depicted in the referenced drawings.

The addition of vertical linking members (for examples, see FIGS. 5A-5D, discussed hereinbelow) in the above designs would provide the ability to simultaneously operate one or more anti-bow latch members at the same time.

Referring to FIG. 4, in an alternative configuration, instead of having a central operator which controls the engagement and disengagement of multiple upper latches, the present invention also contemplates an arrangement wherein a side activating member 10' is used to operate a single upper latch member 40', with a connection for further operation of one or more corresponding side anti-bow members 60' on the same side. In such an arrangement, the more commonly seen sliding or pivoting tilt latch activating members may be used for retracting both the upper latch member and anti-bow latch member on the same side at the same time, in a manner similar to that discussed elsewhere in this disclosure.

Consequently, for the above alternative embodiment, a pair of activating members would be necessary, one on each side of the window, in order to retract all of the upper and anti-bow latches, and thus tilt the window. For many situations, this is less desirable than a single, central operator that can operate all of the latches simultaneously, but the dual activating member solution might be chosen for situations where the use of a central operator is not desired, or is not possible (such as where there is a central lock device, for example, for locking the window shut).

Figure 5A:
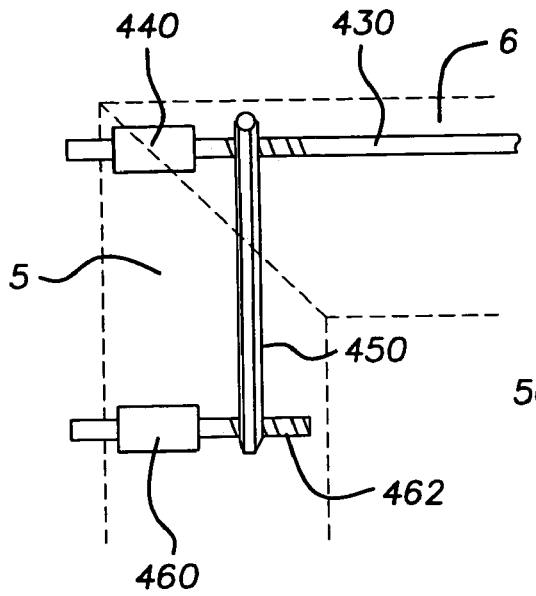
FIG. 5A shows a front sectional view of a portion of the locking system in accordance with an embodiment of the invention utilizing horizontal toothed members and a rotating gear shaft.

Now referring to FIG. 5A, in providing joint operation of both an upper latch member and an anti-bow latch member, one possible embodiment of the invention would employ an extended gear shaft 450, extending from the upper sash rail 6 into the sash stile 5 and engaged with a toothed rack portion of an upper horizontal linkage member 430 and a toothed rack portion of a lower horizontal linkage member 462. The upper horizontal linkage member 430 is connected upper latch member 440 for retracting the upper latch member 440. Thus, retraction (and, if desired, extension) of the upper linkage member 430, by activating the activating member, will result in a translation of a lateral movement of the upper horizontal linkage member to the lower horizontal linkage member through the rotation of gear shaft 450, causing a simultaneous or near simultaneous extension or retraction of the upper latch member 440 and the anti-bow latch member 460.

Figure 5B:
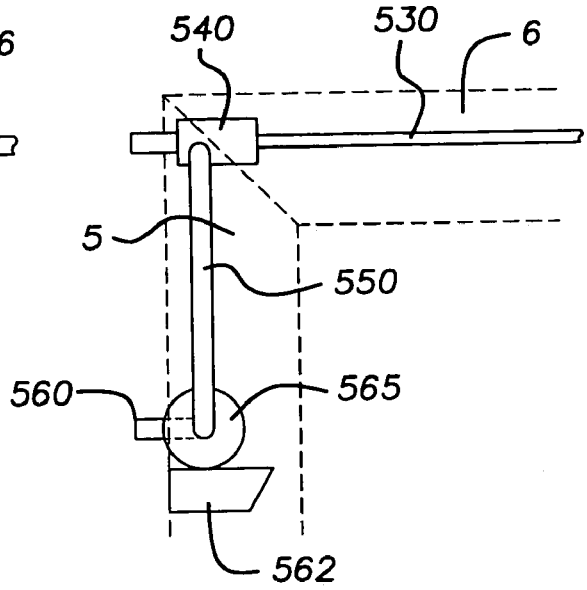
FIG. 5B shows a front sectional view of a portion of the locking system in accordance with an embodiment of the invention utilizing a horizontal sliding member, a vertical linkage member, and a rolling member.

Referring to FIG. 5B, another possible embodiment of the invention would utilize a vertical linkage member 550, rigidly connected to either an upper latch member 540 or an upper linkage member 530 on one end, and connected to the central axis of rolling member 565 on the opposite end. The rolling member 565, to which a side anti-bow latch member 560 is attached, is supported by a fixed track 562 within the window sash stile 5. Extension or retraction of the upper linkage member 530 and connected upper latch member 540, by a means defined above, will result in a lateral movement of the rigidly connected vertical linkage member 550, causing the rolling member 565 to roll along the fixed track 562, thereby extending or retracting the anti-bow latch member 560.

Figure 5C:
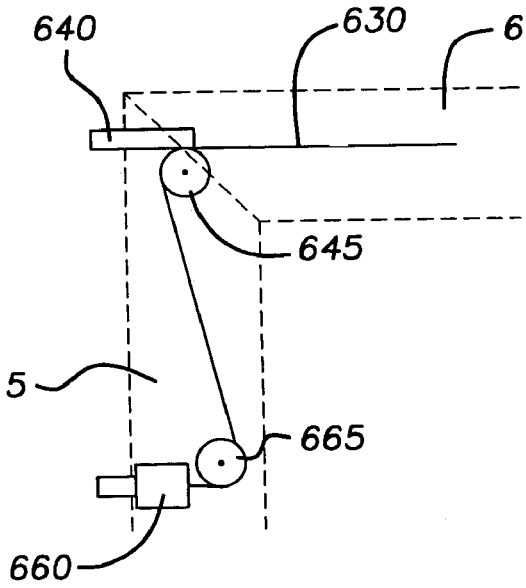
FIG. 5C shows a front sectional view of a portion of the locking system in accordance with an embodiment of the invention utilizing a retracting cable and pulleys.

Referring to FIG. 5C, yet another possible embodiment of the invention would include a cable and pulley system in which a retracting cable 630 is used to retract the upper latch member 640. Further, the retracting cable 630 extends downward into the window stiles by means of a fixed pulley 645 within the sash rail (or in the stile), allowing the cable to retract the spring-loaded side anti-bow latch member 660 by means of a second fixed pulley 665 within the sash stile.

Figure 5D:
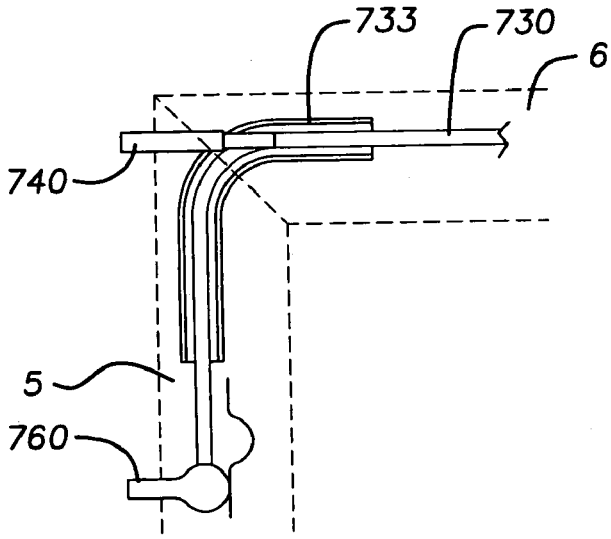
FIG. 5D shows a front sectional view of a portion of the locking system in accordance with an embodiment of the invention utilizing a flexible tape-like member and an L-shaped slotted track.

Referring to FIG. 5D, still another possible embodiment of the invention provides a flexible tape-like member 730 disposed within an L-shaped track 733, which, when drawn in, retracts the upper latch member 740 attached to the tape 730, and lifts a contoured anti-bow latch member 760, attached to the end of the: tape 730, into a recess in the sash stile to disengage the anti-bow latch member 760 from the slide channel 8 (shown in FIGS. 1A and 1B). In an alternate configuration, the operating mechanism could be arranged so that retraction of the tape 730 would cause the upper latch member 740 and anti-bow latch member 760 to disengage from the slide channel.

Referring to FIG. 6, yet another possible embodiment of the invention would include at least one separate anti-bow latch member 860 connected to a side anti-bow activating member 810, assembled to the sash stile 5. The activating member 810 may comprise one of many possible designs, including a pivoting lever, a sliding latch, or a spring-loaded knob that can be pulled and locked in the retracted position, as shown in FIG. 6, allowing the anti-bow latch member 860 to remain disengaged while other latches are operated.

Additional means for retracting the side anti-bow latches may include vertical linkage mechanisms connected to the horizontal linkage mechanisms and to the end of a pivoting side anti-bow latch member, where retraction of the horizontal linkage mechanism will cause the vertical linkage to pull the end of the pivoting anti-bow latch member, causing it to engage or disengage with the slide channel. Additionally, the mechanism for retracting the anti-bow latch members may operate independently from the mechanism for operating the upper latch members, utilizing such means as a separate cable and pulley system or a separate rack and extended shaft gear assembly. The invention also contemplates a system in which the activating member is connected to, and capable of actuating, a plurality of anti-bow latch members disposed along the length of the sash stile.

The possible embodiments of the latch operating mechanisms are not limited to those depicted in the referenced drawings or as described above, but include other possible implementations known and unknown in the art.

The invention has been described hereinabove using specific examples and embodiments; however, it will be understood by those skilled in the art that various alternatives may be used and equivalents may be substituted for elements or steps described herein, without deviating from the scope of the invention. Modifications may be necessary to adapt the invention to a particular situation or to particular needs without departing from the scope of the invention. It is intended that the invention not be limited to the particular implementation described herein, but that the claims be given their broadest interpretation to cover all embodiments, literal or equivalent, covered thereby.

What is claimed is:

1. A window assembly including a latching system for a pivoting window sash having a pivoting end and a non-pivoting end, said latching system comprising:

an upper latch member disposed near the non-pivoting end of the window sash;

an anti-bow latch member disposed between the pivoting end of the window sash and said upper latch member;

an activating member operationally connected to said upper latch member and said anti-bow latch member for operating both said upper latch member and said anti-bow latch member, wherein the pivoting window sash further includes a sash rail and a sash stile, said upper latch member being at least partially disposed within the sash rail and said anti-bow latch member being at least partially disposed within the sash stile, operation of the activating member retracting said upper latch member and said anti-bow latch member generally at the same time, wherein the pivoting window sash is slidable within a slide channel of a window frame of said window assembly and both of said upper latch member and said anti-bow latch member are independently engageable with the slide channel of the window frame, and an operating mechanism, said activating member being connected to said anti-bow latch member via said operating mechanism, the operating mechanism including a horizontal linking member connected to both of said activating member and said upper latch member; and a vertical linking member connected to both of said anti-bow latch member and at least one of said horizontal linking member and said upper latch member, wherein each of the horizontal linking member and the vertical linking member include a flexible element adapted to support a tensile force, but not generally adapted to support a compressive force.

2. The window assembly of claim 1, wherein said activating member further including a rotating cam connected to said horizontal linking member.

3. The window assembly of claim 2, wherein said flexible element includes a retractable cable, and said operating mechanism includes spring-loaded means for extending said retractable cable.

4. The window assembly of claim 2, wherein said vertical linking member includes a pivoting component disposed in the sash stile and connected to said anti-bow latch member.

5. The window assembly of claim 1, wherein said pivoting window sash further includes an L-shaped slot, and said flexible element includes a flexible tape member disposed in the L-shaped slot and connected to said activating member.

6. The window assembly of claim 1, wherein said activating member is mounted to the window sash.

7. A window assembly, including:

a pivoting window sash having a horizontal sash rail and a vertical sash stile; and a latching system, including:

an upper latch member at least partially disposed within the horizontal sash rail, extendable through an opening in the vertical sash stile, and movable to at least an extended position, wherein in the extended position the upper latch member is configured to engage a slide channel of a window frame;

an anti-bow latch member at least partially disposed within the vertical sash stile, extendable through an opening in the vertical sash stile, and movable to at least an extended position, wherein in its said extended position the anti-bow latch member is configured to engage the slide channel of the window frame;

an activating member disposed on the sash rail; and an operating mechanism connecting said activating member with both of said upper latch member and said anti-bow latch member, actuation of said activating member causing both of said upper latch member and said anti-bow latch member to move from the extended position to a retracted position via said operating mechanism generally at the same time, wherein in the retracted position both of said upper latch member and said anti-bow latch member are configured to disengage from the slide channel of the window frame to permit the pivoting window sash to pivot to a tilted position, wherein said operating mechanism further includes a horizontal linking member at least partially disposed in the horizontal sash rail and connected to both of said upper latch member and said activating member; and a vertical linking member at least partially disposed in the vertical sash stile and connected to both of said anti-bow latch member and at least one of said activating member, said horizontal linking member, and said upper latch member, wherein each of the horizontal linking member and the vertical linking member include a flexible tape member, and wherein said pivoting window sash further includes an L-shaped track, the vertical linking member being disposed within the L-shaped track.

8. The window assembly of claim 7, wherein in the extended position both of said upper latch member and said anti-bow latch member are configured to engage the slide channel of the window frame to retain the pivoting window sash in a non-tilted position.

9. A window assembly, including:

a pivoting window sash having a first side, a second side, and a pivoting end;

a window frame having a first slide channel and a second slide channel; and a latching system, including:

a first upper latch member disposed on the first side of the pivoting window sash for engaging the first slide channel of the window frame;

a second upper latch member disposed on the second side of the pivoting window sash for engaging the second slide channel of the window frame;

a first anti-bow latch member disposed on the first side of the pivoting window sash between said first upper latch member and said pivoting end for engaging the first slide channel of the window frame;

a second anti-bow latch member disposed on the second side of the pivoting window sash between said second upper latch member and said pivoting end for engaging the second slide channel of the window frame;

an activating member disposed on the pivoting window sash;

a first horizontal linking member operationally connecting said activating member with said first upper latch member; and a first vertical linking member operationally connecting said activating member with said first anti-bow latch member, actuation of said activating member disengaging both of said first upper latch member and said first anti-bow latch member from the first slide channel of the window frame generally at the same time, wherein each of the horizontal linking member and the vertical linking member include a flexible tape member, and wherein said first vertical linking member is operationally connected to said activating member via said first horizontal linking member.

10. The window assembly of claim 9, further including:

a second activating member;

a second horizontal linking member operationally connecting said second activating member with said second upper latch member; and a second vertical linking member operationally connecting said second activating member with said second anti-bow latch member, actuation of said second activating member disengaging both of said second upper latch member and said second anti-bow latch member from the second slide channel.

11. The window assembly of claim 9, further including:

a second horizontal linking member operationally connecting said activating member with said second upper latch member; and a second vertical linking member operationally connecting said activating member with said second anti-bow latch member, actuation of said activating member also disengaging said second upper latch member and said second anti-bow latch member from the second slide channel.

12. The window assembly of claim 11, wherein said first vertical linking member is operationally connected to said activating member via said first horizontal linking member, and said second vertical linking member is operationally connected to said activating member via said second horizontal linking member.

13. A window assembly, including:

a pivoting window sash having a first side, a second side, a pivoting end, a non-pivoting end, and a sash rail; and a latching system, including:

a first upper latch member disposed on the first side of the pivoting window sash near the non-pivoting end and movable to at least an extended position, wherein in the extended position the first upper latch member is configured to engage a first slide channel of a window frame;

a second upper latch member disposed on the second side of the pivoting window sash near the non-pivoting end and movable to at least an extended position, wherein in its said extended position the second upper latch member is configured to engage a second slide channel of the window frame;

a first anti-bow latch member disposed on the first side of the pivoting window sash between the pivoting end and the first upper latch member and movable to at least an extended position, wherein in its said extended position the first anti-bow latch member is configured to engage the first slide channel of the window frame;

a second anti-bow latch member disposed on the second side of the window sash between the pivoting end and the second upper latch member and movable to at least an extended position, wherein in its said extended position the second anti-bow latch member is configured to engage the second slide channel of the window frame;

a single activating member centrally disposed on the sash rail;

a first horizontal linking member connecting said activating member with said first upper latch member;

a second horizontal linking member connecting said activating member with said second upper latch member;

a first vertical linking member connecting said first horizontal linking member with said first anti-bow latch member, said first vertical linking member being disposed within a first curved track; and a second vertical linking member connecting said second horizontal linking member with said second anti-bow latch member, said second vertical linking member being disposed within a second curved track, wherein each of said first horizontal linking member, second horizontal linking member, first vertical linking member, and second vertical linking member include a flexible tape member, actuation of said single activating member causing both of said first upper latch member and said first anti-bow latch member to move from the extended position to a retracted position and both of said second upper latch member and said second anti-bow latch member to move from the extended position to a retracted position, wherein in the retracted position both of said first upper latch member and said first anti-bow latch member are configured to disengage from the first slide channel of the window frame and both of said second upper latch member and said second anti-bow latch member are configured to disengage from the second slide channel of the window frame to permit the pivoting window sash to pivot to a tilted position, wherein actuation of said single activating member causes all of said latch members to move from the extended position to the retracted position generally simultaneously.

14. A window assembly, including:

a pivoting window sash having a first side, a second side, a pivoting end, a non-pivoting end, and a sash rail; and a latching system, including:

a first upper latch member disposed on the first side of the pivoting window sash near the non-pivoting end and movable to at least an extended position, wherein in the extended position the first upper latch member is configured to engage a first slide channel of a window frame;

a second upper latch member disposed on the second side of the pivoting window sash near the non-pivoting end and movable to at least an extended position, wherein in the extended position its said second upper latch member is configured to engage a second slide channel of the window frame;

a first anti-bow latch member disposed on the first side of the pivoting window sash between the pivoting end and said first upper latch member and movable to at least an extended position independently of the first upper latch member, wherein in its said extended position the first anti-bow latch member is configured to engage the first slide channel of the window frame;

a second anti-bow latch member disposed on the second side of the window sash between the pivoting end and the second upper latch member and movable to at least an extended position independently of the second upper latch member, wherein in its said extended position the second anti-bow latch member is configured to engage the second slide channel of the window frame;

a first activating member disposed on the sash rail toward said first side of the pivoting window sash and connected to said first upper latch member;

a second activating member disposed on the sash rail toward said second side of the pivoting window sash and connected to said second upper latch member;

a first vertical linking member connecting said first activating member with said first anti-bow latch member; and a second vertical linking member connecting said second activating member with said second anti-bow latch member, wherein actuation of said first activating member causing both of said first upper latch member and said first anti-bow latch member to move from the extended position to a retracted position generally simultaneously and, wherein in the retracted position both of said first upper latch member and said first anti-bow latch member are configured to disengage from the first slide channel of the window frame, and actuation of said second activating member causing both of said second upper latch member and said second anti-bow latch member to move from the extended position to a retracted position generally simultaneously, wherein in their said retracted position both of said second upper latch member and said second anti-bow latch member are configured to disengage from the second slide channel of the window frame to permit the pivoting window sash to pivot to a tilted position, wherein each of the first and second vertical linking members include a flexible tape member, wherein actuation of said first activating member causes a tensile force to be applied to the first vertical linking member to thereby cause the first anti-bow latch member to be moved to its said retracted position, and wherein actuation of said second activating member causes a tensile force to be applied to the second vertical linking member to thereby cause the second anti-bow latch member to be moved to its said retracted position.

15. A window assembly including a latching system for a pivoting window sash having a pivoting end and a non-pivoting end, said latching system comprising:

an upper latch member disposed near the non-pivoting end of the window sash;

an anti-bow latch member disposed between the pivoting end of the window sash and said upper latch member;

an activating member operationally connected to said upper latch member and said anti-bow latch member for operating both said upper latch member and said anti-bow latch member;

an operating mechanism, said activating member being connected to anti-bow latch member via said operating mechanism, wherein said operating mechanism includes a horizontal linking member connected to said upper latch member, and a vertical linking member connected to both of said anti-bow latch member and at least one of said horizontal linking member and said upper latch member, said activating member further including a rotating cam connected to said horizontal linking member, and wherein said horizontal linking member has a toothed rack portion, and wherein said vertical linking member includes a gear shaft engaged with said toothed rack portion, and a toothed lower member disposed in a stile of the sash, said toothed lower member being engaged with said gear shaft and being connected to said anti-bow latch member.

16. A window assembly including a latching system for a pivoting window sash having a pivoting end and a non-pivoting end, said latching system comprising:

an upper latch member disposed near the non-pivoting end of the window sash;

an anti-bow latch member disposed between the pivoting end of the window sash and said upper latch member;

an activating member operationally connected to said upper latch member and said anti-bow latch member for operating both said upper latch member and said anti-bow latch member;

an operating mechanism, said activating member being connected to at least one of said upper latch member and said anti-bow latch member via said operating mechanism, and wherein said operating mechanism includes a retractable cable connected to said anti-bow latch member, at least one pulley disposed in a stile of the sash, said activating member including a rotating cam, said retractable cable being connected to said rotating cam and directed by said pulley, said retractable cable being windable around said rotating cam; and means for extending said retractable cable.

* * * * *